US006325966B1

(12) United States Patent
Jeong et al.

(10) Patent No.: US 6,325,966 B1
(45) Date of Patent: Dec. 4, 2001

(54) ZIRCONIUM ALLOY HAVING HIGH CORROSION RESISTANCE AND HIGH STRENGTH

(75) Inventors: Yong Hwan Jeong; Jong Hyuk Baek; Kyeong Ho Kim; Sun-Jae Kim; Byong Kwon Choi; Youn Ho Jung, all of Taejon-si (KR)

(73) Assignees: Korea Atomic Energy Research Institute, Taejon-si; Korea Electric Power Corporation, Seoul, both of (KR)

( * ) Notice: Subject to any disclaimer, the term of this patent is extended or adjusted under 35 U.S.C. 154(b) by 0 days.

(21) Appl. No.: 09/293,099

(22) Filed: Apr. 16, 1999

(30) Foreign Application Priority Data

Oct. 21, 1998 (KR) ..... 98-44127

(51) Int. Cl.[7] ..... C22C 16/00
(52) U.S. Cl. ..... 420/422; 420/423; 148/421
(58) Field of Search ..... 420/422, 423; 148/421

(56) References Cited

U.S. PATENT DOCUMENTS

| | | | | |
|---|---|---|---|---|
| 4,649,023 | | 3/1987 | Sabol et al. | 420/422 |
| 4,879,093 | | 11/1989 | Garde | 420/422 |
| 4,938,920 | * | 7/1990 | Garzarolli et al. | 376/457 |
| 4,963,316 | * | 10/1990 | Stehle et al. | 376/416 |
| 4,963,323 | | 10/1990 | Matsuo et al. | 420/422 |
| 4,992,240 | * | 2/1991 | Komatsu et al. | 420/422 |
| 5,017,336 | | 5/1991 | Matsuo et al. | 420/422 |
| 5,080,861 | | 1/1992 | Garde | 420/422 |
| 5,112,573 | | 5/1992 | Foster et al. | 420/422 |
| 5,125,985 | | 6/1992 | Foster et al. | 148/672 |
| 5,196,163 | | 3/1993 | Matsuo et al. | 420/422 |
| 5,211,774 | | 5/1993 | Garde et al. | 148/421 |
| 5,230,758 | | 7/1993 | Foster et al. | 148/672 |
| 5,241,571 | * | 8/1993 | Pati et al. | 376/260 |
| 5,244,514 | | 9/1993 | Garde | 148/421 |
| 5,296,058 | * | 3/1994 | Steinberg | 148/672 |
| 5,334,345 | * | 8/1994 | Rudling | 420/422 |
| 5,366,690 | * | 11/1994 | Garde | 420/422 |
| 5,802,130 | * | 9/1998 | Mardon et al. | 376/457 |
| 5,887,045 | * | 3/1999 | Mardon et al. | 376/457 |
| 5,972,288 | * | 10/1999 | Jeong et al. | 420/422 |
| 5,985,211 | * | 11/1999 | Jeong et al. | 420/423 |

* cited by examiner

*Primary Examiner*—Roy King
*Assistant Examiner*—Nicole Coy
(74) *Attorney, Agent, or Firm*—Bachman & LaPointe, P.C.

(57) ABSTRACT

The invention presented herein relates to a zirconium alloy with superior corrosion resistance and high strength for use in fuel rod claddings, spacer grids and structural components in reactor core of light water and heavy water nuclear power plant.

The zirconium alloy of this invention with superior corrosion resistance and high strength comprises an alloy composition as follows: niobium in a range of 0.15 to 0.25 wt. %; tin in a range of 1.10 to 1.40 wt. %; iron in a range of 0.35 to 0.45; chromium in a range of 0.15 to 0.25; one element selected from the group consisting of molybdenum, copper and manganese in a range of 0.08 to 0.12 wt. %; oxygen in a range of 0.10 to 0.14 wt. %; and the balance being zirconium.

1 Claim, 3 Drawing Sheets

ZIRCONIUM ALLOY HAVING HIGH CORROSION RESISTANCE AND HIGH STRENGTH

BACKGROUND OF THE INVENTION

The invention presented herein relates to the composition of zirconium(Zr) alloy having superior corrosion resistance and high strength. In particular, this invention relates to the alloys with superior corrosion resistance and high strength for fuel claddings, spacer grids, and core structural components in light water reactor(LWR) and heavy water reactor (HWR).

Zircaloy has been developed in the early 1960s and has been widely used as fuel rod cladding and structural elements of nuclear reactor core. As the operating conditions of nuclear power plants tend to be at high burn-up, increased operating, Zircaloy-4 could not be utilized as fuel rod cladding.

U.S. Pat. No. 4,649,023 relates to the zirconium alloys, which comprise the following alloy composition, and the manufacturing process of the intermediate and final product thereof. niobium, in a range of 0.5 to 2.0 wt. %;

tin, up to 1.5 wt. %;

a third alloying element, minimum 0.25 wt. %; and the balance being zirconium. The third alloying element is one of constituent such as iron, chromium, molybdenum, vanadium, copper and tungsten.

This alloy is characterized to have the a microstructure with homogeneously dispersed fine precipitates of less than about 800 Å. This was included to improve corrosion resistance in high temperature steam by controlling its microstructure.

The zirconium alloy with similar corrosion resistance to that in U.S. Pat. No. 4,649,023 is suggested in U.S. Pat. Nos. 5,112,573 and 5,230,758. This alloy includes niobium in a range of 0.5 to 2.0 wt. %, tin in a range of 0.7 to 1.5 wt. %, at least one element selected from the group consisting of iron, nickel and chromium in a range of 0.03 to 0.14 wt. %, and carbon up to 220 ppm, wherein the total amount of nickel and chromium is at least 0.12 wt. %. And, corrosion resistance is improved by chromium and nickel in a range of 0.03 to 0.08 wt. %, respectively.

U.S. Pat. No. 5,125,985 discloses the zirconium alloys, which comprise the following alloy composition:

niobium, in a range of 0.5 to 2.0 wt. %;

tin , in a range of 0.7 to 1.5 wt. %;

one element from iron, nickel, and chromium, 0.07 to 0.28 wt. % (optional);

carbon, up to 220; and the balance being of zirconium.

This improved the corrosion resistance and the strength by controlling the distribution and distance of the precipitates by optimizing the heat treatment and working conditions.

U.S. Pat. No. 4,879,093 discloses the zirconium alloy by adding up to 0.6 wt. % of niobium or up to 0.1 wt. % of molybdenum in the Zircaloy. The amount of oxygen was in a range of 1000 to 1600 ppm, and the equivalent diameter of precipitates was in a range of 1200 to 1800 Å. U.S. Pat. No. 5,080,861 developed the zirconium alloy with the retention of coherency of barrier oxide layer at the interface for minimizing the corrosion acceleration due to the precipitation of hydrogon compound at the interface between metal and oxide. This alloy includes up to 0.6 wt. % of niobium, tin in a range of 0.5 to 1.0 wt. %, one element selected from the group consisting of tellurium, antimony and silicon up to 0.2 wt. %, less than 70 ppm of nickel, less than 200 ppm of carbon in the Zircaloy. The amount of oxygen was in a range of 900 to 2000 ppm, and the equivalent diameter of the precipitates was 1200 to 1800 Å. The addition of tellurium, antimony and silicon decreases the hydrogen uptake and the precipitatation rate and makes the coherency retained at the interface between metal and oxide layer under the circumstances of the extended and high burn-up fuel, which improves the corrosion resistance.

The improved zirconium alloy based on the above patent, U.S. Pat. No. 5,080,861 and U.S. Pat. No. 4,879,093 was additionally issued in U. S. Pat. No. 5,211,774. This alloy, which has a similar alloy composition to that in the above patent, has improved properties in ductility, creep strength and corrosion resistance under the neutron irradiation. It comprises an alloying composition as follows:

tin, in a range of 0.8 to 1.2 wt. %;

niobium up to 0.6 wt. % (typically up to 0.3 wt. %);

iron, in a range of 0.2 to 0.5 wt. % (typically 0.35 wt. %);

chromium, in a range of 0.1 to 0.4 wt. % (typically 0.25 wt. %);

silicon, in a range of 50 to 200 ppm (typically 100 ppm);

oxygen, in a range of 900 to 1800 ppm (typically 1600 ppm); and the balance being of zirconium.

In this alloy, silicon decreases hydrogen uptake, and decreases the variation of corrosion resistance due to various working condition.

U.S. Pat. No. 5,244,514 also discloses the zirconium alloy including a smaller amount of tin as compared with the former existing Zircaloys, and has a low capture cross section of thermal neutrons, superior corrosion resistance, low hydrogen uptake, good workability and improved creep resistance. This alloy is composed of vanadium up to 1.0 wt. %, up to 1.0 wt. % of niobium, up to 0.2 wt. % of antimony and tellurium, up to 0.5 wt. % of tin, iron in a range of 0.2 to 0.5 wt. %, chromium in a range of 0.1 to 0.4 wt. %, silicon in a range of 50 to 200 ppm, up to 2200 ppm of oxygen, and the balance being of zirconium. The vanadium compound ($ZrV_2$), which is the precipitate formed in this alloy provides good creep resistance, coarsening resistance, low neutron absorption, and stability in neutron flux and in high burn-up.

Alloys with improved corrosion resistance by adjusting the composition of the former existing Zircaloy-4 or adding niobium, tantalum, vanadium and molybdenum are in U.S. Pat. No. 4,963,323, 5,017,336, 5,196,163. Alloy in U.S. Pat. No. 4,963,323 adjusted the composition of the former existing Zircaloy-4. That is, the amount of tin was decreased and niobium was added as compensation, and the amount of nitrogen was controlled to less than 60 ppm in this alloy. Therefore, the alloy included tin in a range of 0.2 to 1.15 wt. %, iron in a range of 0.19 to 0.6 wt. % (typically 0.19 to 0.24 wt. %), chromium in a range of 0.07 to 0.4 wt. % (typically in a range of 0.07 to 0.13 wt. %), niobium in a range of 0.05 to 0.5 wt. %, and less than 60 ppm of nitrogen. U.S. Pat. No. 5,017,336 discloses the improved Zircaloy-4 with niobium, tantalum(Ta), vanadium, and molybdenum, and this alloy comprises an alloy composition as follows:

tin, in a range of 0.2 to 0.9 wt. %;

iron, in a range of 0.18 to 0.6 wt. %;

chromium, in a range of 0.07 to 0.4 wt. %;

niobium, in a range of 0.05 to 0.5 wt. %;

tantalum, in a range of 0.01 to 0.2 wt. %;

vanadium, in a range of 0.05 to 0.1 wt. %;

molybdenum, in a range of 0.05 to 0.1 wt. %; and the balance being of zirconium.

And U. S. Pat. No. 5,196,163 discloses the improved zirconium alloy which composition is equal to that of U.S. Pat. No. 4,963,323 except adding tantalum in a range of 0.01 to 0.2 wt. % further.

In U. S. Pat. No. 5,560,790, the distance between the precipitates, $Zr(Nb, Fe)_2$ and Zr(Fe, Cr, Nb)was limited to the range of 0.20 to 0.40 $\mu$m, and the volume of the precipitate containing iron was limited to 60% of the total volume of precipitate for the improvement of corrosion resistance. This alloy comprises an alloy composition as follows:

niobium, in a range of 0.5 to 1.5 wt. %;

tin, in a range of 0.9 to 1.5 wt. %;

iron, in a range of 0.3 to 0.6 wt. %;

chromium, in a range of 0.005 to 0.2 wt. %;

carbon, in a range of 0.005 to 0.04 wt. %;

oxygen in a range of 0.005 to 0.15 wt. %;

silicon in a range of 0.005 to 0.15 wt. %; and the balance being of zirconium.

As described above, the efforts to improve the corrosion resistance and the mechanical strength of alloy have been done. However, considering the circumstances of the extended and high burn-up fuel for the low cost, the use of Zircaloys as material for fuel rod cladding becomes limited due to enhanced corrosion and irradiation creep. Therefore, the development of an advanced zirconium alloy with high strength and corrosion resistance has been required.

We, the inventors of this invention, have investigated the enhancement of the corrosion resistance for the improvement of the creep in neutron flux and the corrosion acceleration of zirconium alloy which can be utilized as fuel rod claddings, spacer grids and structural components under the circumstances of the extended and high burn-up fuel. We first tested the effect of adding elements on the corrosion resistance, tensile and creep characteristics considering the effect of neutron flux, cost, workability, forming ability with base material, and determined the content of elements and the composition of alloys. Thereby we developed the zirconium alloys having higher corrosion resistance and strength than the former existing Zircaloy-4.

SUMMARY OF TEE INVENTION

It is the objective of this invention to provide an advanced zirconium alloy with superior corrosion resistance and high strength suitable for the material used in fuel rod cladding, spacer grid, and other structural components in the reactor core of nuclear power plants.

DESCRIPTION OF THE PREFERRED EMBODIMENTS

Figure 1:
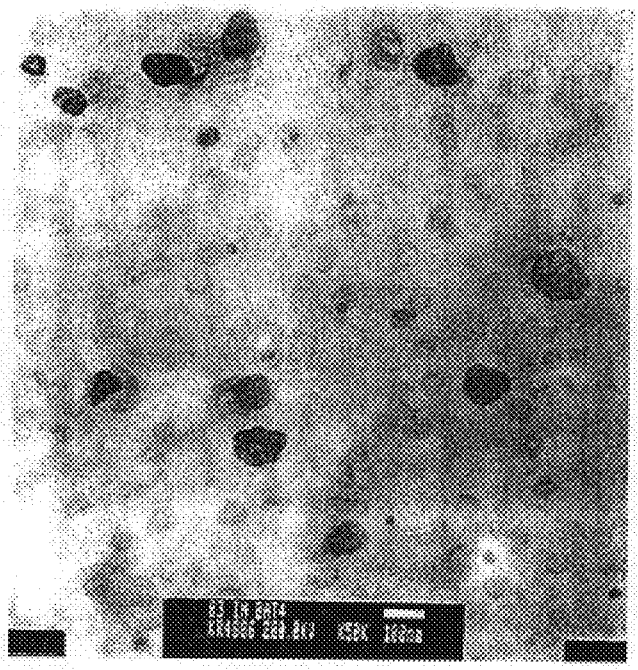
FIG. 1 is an electron micrograph showing the microstructure of zirconium alloy of embodiment 2 of the present invention.
Figure 2:
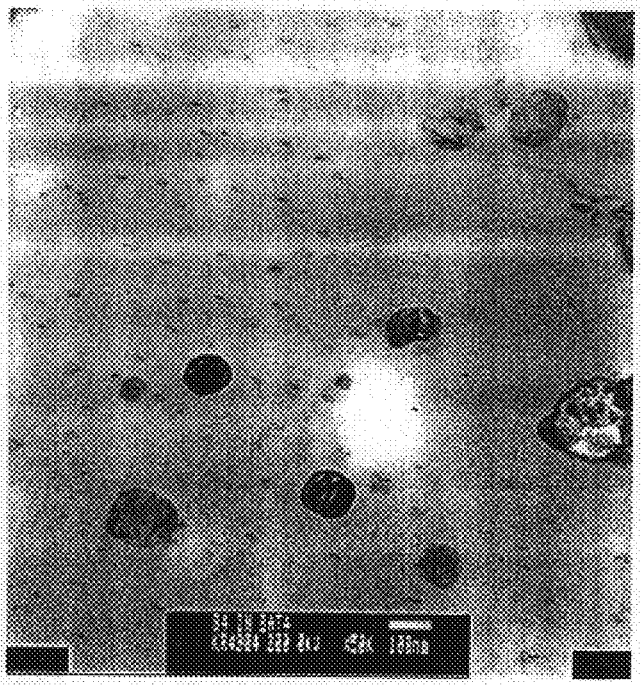
FIG. 2 is an electron micrograph showing the microstructure of zirconium alloy of embodiment 3 of the present invention.
Figure 3:
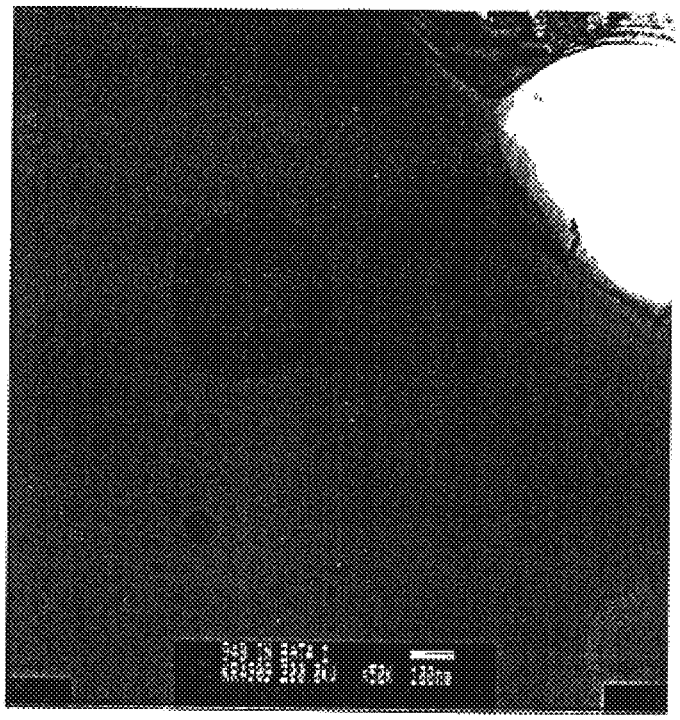
FIG. 3 is an electron micrograph showing the microstructure of zirconium alloy of embodiment 4 of the present invention.

In order to attain the above objective, the zirconium alloys with the alloying elements and the composition different with the former existing Zircaloy-4 are provided.

The present invention will now be described in detail.

The present invention provides a zirconium alloy with superior corrosion resistance and high mechanical characteristics suitable for the material used in fuel rod cladding, spacer grid, and other structural components in the reactor core of nuclear power plants.

The zirconium alloy with superior corrosion resistance and high strength according to the present invention comprises niobium in a range of 0.15 to 0.25 wt. %; tin in a range of 1.10 to 1.40 wt. %; iron in a range of 0.35 to 0.45 wt. %; chromium in a range of 0.15 to 0.25 wt. %; one element selected from the group consisting of molybdenum, copper and manganese in a range of 0.08 to 0.12 wt. %; oxygen in a range of 0.10 to 0.14 wt. %; and the balance being zirconium.

Also, the zirconium alloy according to the present invention comprises iron in a range of 0.80 to 1.20 wt. %; oxygen in a range of 0.10 to 0.14 wt. %; and the balance being zirconium. And the elements selected from the following groups may be further included: i) niobium in a range of 0.15 to 0.35 wt. %; ii) one element selected from the group consisting of copper, molybdenum and manganese in a range of 0.15 to 0.25 wt. %; iii) tin in a range of 0.45 to 0.60 wt. %; and iv) tin in a range of 0.45 to 0.60 wt. % and niobium in a range of 0.15 to 0.25 wt. %.

Also, the zirconium alloy according to the present invention comprises tin in a range of 0.80 to 1.20 wt. %; niobium in a range of 0.15 to 0.25 wt. %; oxygen in a range of 0.10 to 0.14 wt. %; and the balance being zirconium. Iron may be included in a range of 0.15 to 0.25 wt. % instead of niobium and one element selected from the group consisting of manganese and molybdenum in a range of 0.15 to 0.25 wt. % may be further added.

The aforesaid composition of zirconium alloy is shown in Table I.

TABLE I

| | | The composition of zirconium alloy unit (wt. %) | | | | | | | | |
|---|---|---|---|---|---|---|---|---|---|---|
| Group | No. | Nb | Sn | Fe | Cr | Mo | Cu | Mn | O | Zr |
| 1 | 1 | .15–.25 | 1.10–1.40 | .35–.45 | .15–.25 | .08–1.2 | — | — | .10–.14 | balance |
| | 2 | .15–.25 | 1.10–1.40 | .35–.45 | .15–.25 | — | .08–1.2 | — | .10–.14 | |
| | 3 | .15–.25 | 1.10–1.40 | .35–.45 | .15–.25 | — | — | .08–1.2 | .10–.14 | |
| 2 | 4 | — | — | .80–1.20 | — | — | — | — | .10–.14 | balance |
| | 5-1 | .15–.25 | — | .80–1.20 | — | — | — | — | .10–.14 | |
| | 5-2 | .25–.35 | — | .80–1.20 | — | — | — | — | .10–.14 | |
| | 6 | — | — | .80–1.20 | — | — | .15–.25 | — | .10–.14 | |
| | 7 | — | — | .80–1.20 | — | .15–.25 | — | — | .10–.14 | |
| | 8 | — | — | .80–1.20 | — | — | — | .15–.25 | .10–.14 | |
| | 9 | — | .45–.60 | .80–1.20 | — | — | — | — | .10–.14 | |
| | 10 | .15–.25 | .45–.60 | .80–1.20 | — | — | — | — | .10–.14 | |
| 3 | 11 | .15–.25 | .80–1.20 | — | — | — | — | — | .10–.14 | balance |
| | 12 | — | .80–1.20 | .15–.25 | — | — | — | — | .10–.14 | |
| | 13 | .15–.25 | .80–1.20 | — | — | .15–.25 | — | — | .10–.14 | |
| | 14 | .15–.25 | .80–1.20 | — | — | — | — | .15–.25 | .10–.14 | |

For the purposes of illustration the invention has been described by referring to specific examples, but the present invention is not limited to the preferred embodiments.

Embodiments 1–14

Preparation of Zirconium Alloys (1)–(14)

The zirconium alloys with the composition of below Table II were prepared. The manufacturing process and the preferred embodiments, also, have been described.

TABLE II

| | Embodiment | The composition of zirconium alloy unit (wt. %) | | | | | | | | |
|---|---|---|---|---|---|---|---|---|---|---|
| Group | No. | Nb | Sn | Fe | Cr | Mo | Cu | Mn | O | Zr |
| 1 | 1 | 0.22 | 1.40 | 0.43 | 0.21 | 0.11 | — | — | 0.12 | balance |
| | 2 | 0.22 | 1.40 | 0.45 | 0.22 | — | 0.11 | — | 0.10 | |
| | 3 | 0.21 | 1.38 | 0.42 | 0.21 | — | — | 0.08 | 0.13 | |
| 2 | 4 | — | — | 0.90 | — | — | — | — | 0.09 | balance |
| | 5-1 | 0.21 | — | 0.89 | — | — | — | — | 0.12 | |
| | 5-2 | 0.33 | — | 1.06 | — | — | — | — | 0.13 | |
| | 6 | — | — | 0.87 | — | — | 0.19 | — | 0.10 | |
| | 7 | — | — | 0.88 | — | 0.21 | — | — | 0.14 | |
| | 8 | — | — | 0.85 | — | — | — | 0.16 | 0.10 | |
| | 9 | — | 0.59 | 0.88 | — | — | — | — | 0.11 | |
| | 10 | 0.21 | 0.49 | 0.89 | — | — | — | — | 0.13 | |
| 3 | 11 | 0.22 | 1.08 | — | — | — | — | — | 0.12 | balance |
| | 12 | — | 1.07 | 0.21 | — | — | — | — | 0.11 | |
| | 13 | 0.22 | 1.09 | — | — | 0.16 | — | — | 0.14 | |
| | 14 | 0.22 | 1.09 | — | — | — | — | 0.18 | 0.13 | |

The ingot was prepared into a 200 g button form by vacuum arc remelting (VAR) method. To homogenize the alloy composition throughout the ingot, the samples were heated at 1050° C. for 30 minutes, and then cooled in water. The samples were hot-rolled at 700° C. by 60% of its thickness. The samples were annealed at 680° C. for 2 hours and were first cold-rolled to reduce its thickness by 30%. After the first cold-rolling, the sample was annealed for recrystallization at 580° C. for 2 hours and cold-worked twice by 50% of its thickness to make the final thickness 0.7 mm. After the final heat treatment at 505° C. of recrystallization temperature for 2 hours, the specimens for the element analyses, corrosion tests and tensile tests were prepared.

Example 1

The Observation of TEM and the Determination of Size Distribution

Figure 4:
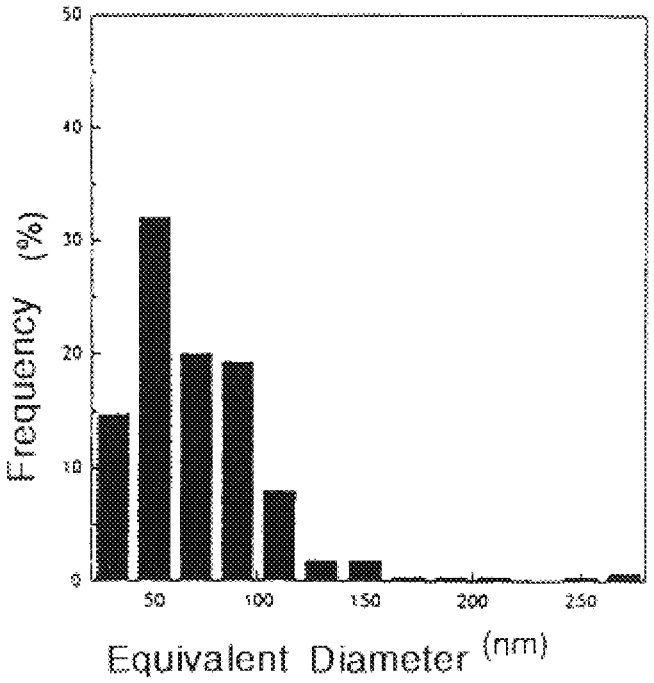
FIG. 4 is a graph showing the equivalent diameter distribution of the precipitates of zirconium alloy of embodiment 2 of the present invention.
Figure 5:
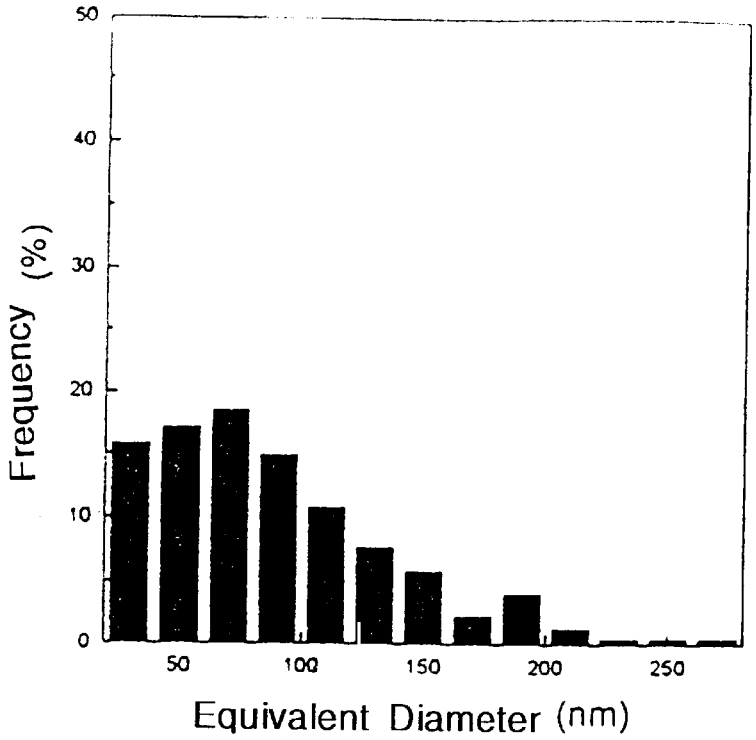
FIG. 5 is a graph showing the equivalent diameter distribution of the precipitates of zirconium alloy of embodiment 3 of the present invention.

For the embodiments 2, 3 and 4, the size and the distribution of precipitates were determined by TEM (transmission electron microscopy). As described in FIG. 4 and 5, for the zirconium alloy of embodiments 1, 2 and 3 the equivalent diameter of precipitates was 71–81 nm and for the zirconium alloy of embodiment 2 which added Cu instead of Mo the average size of precipitates increased and the larger one more than 150 nm was observed. However, the mean area fraction occupied by precipitates was 2.58% for the addition of Mo and was reduced to 2.29% for the addition of Cu.

Figure 6:
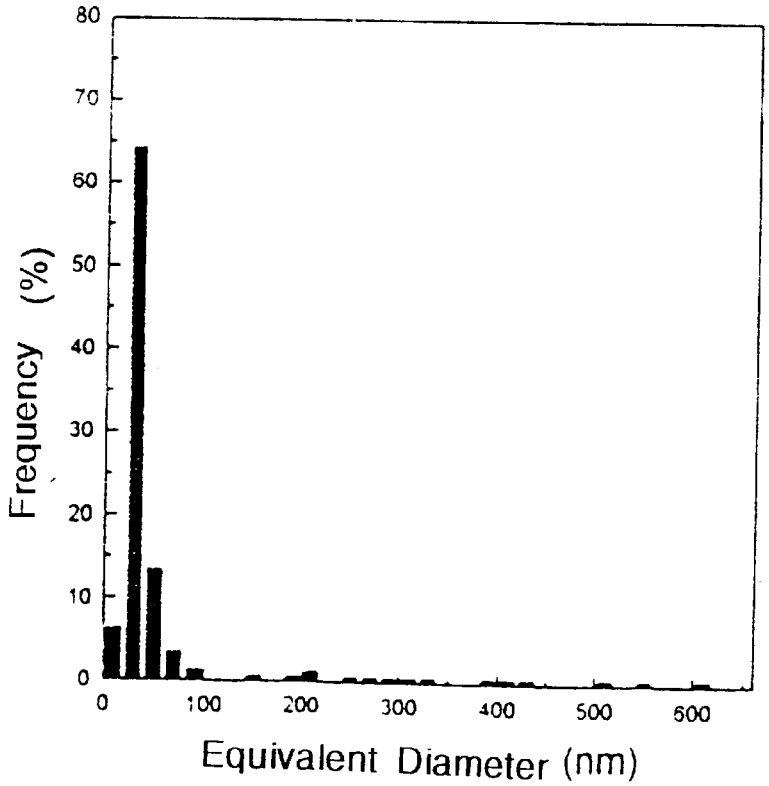
FIG. 6 is a graph showing the equivalent diameter distribution of the precipitates of zirconium alloy of embodiment 4 of the present invention.

FIG. 6 describes the distribution of zirconium alloy of embodiment 4 which have larger content of Fe, up to 1.0 wt. % of Fe. In this case very small precipitates less than 50 nm was more than 75% and large one more than 150 nm (max. 620 nm) was pretty many observed.

Example 2

Corrosion Resistance Tests

Corrosion tests were performed in autoclave with an atmosphere of 360° C. of water (17.5 MPa) and 400° C. of steam (10.3 Mpa) for 80 days and 210 days, respectively. Corrosion rate was quantitatively estimated by measuring the weight gain of corroded sample. The results of corrosion tests are shown in the following Table III.

TABLE III

| | | Corrosion test ($mg/dm^2$) | | | |
|---|---|---|---|---|---|
| | Embodiment | 360° C. | | 400° C. | |
| Group | No. | 80 days | 210 days | 80 days | 210 days |
| 1 | 1 | 30 | — | 73 | — |
| | 2 | 31 | 67 | 64 | 118 |
| | 3 | 29 | 66 | 65 | — |
| 2 | 4 | — | — | 71 | 61 |
| | 5-1 | — | — | 77 | — |
| | 5-2 | — | — | — | 109 |
| | 6 | 32 | — | 62 | — |
| | 7 | 31 | — | 53 | — |
| | 8 | 34 | — | 48 | — |
| | 9 | 36 | — | 53 | 91 |
| | 10 | — | — | 59 | — |
| 3 | 11 | 30 | — | — | — |
| | 12 | 33 | — | 49 | — |
| | 13 | 32 | — | — | — |
| | 14 | 30 | — | 66 | — |
| Zircaloy-4 | | 57 | 96 | 80 | 125 |

As shown in Table III, zirconium alloys Nos. 1 to 14 of this invention displayed a smaller increase in weight and higher corrosion resistance than the former existing Zircaloy-4.

Example 3

Tensile Strength Tests

Tensile tests were also conducted by hydraulic tester with the subsize tensile specimen of ASTM E9 at room temperature and 400° C., respectively. The results of tensile tests are shown in the following Table IV.

TABLE IV

| | | Tensile test (MPa) | | | |
|---|---|---|---|---|---|
| | | Strength (MPa) | | | |
| | | room temp. | | 400° C. | |
| Group | Embodiment No. | yield strength | tensile strength | yield strength | tensile strength |
| 1 | 1 | 506 | 623 | 342 | 381 |
| | 2 | 537 | 656 | 365 | 408 |
| | 3 | 497 | 620 | 352 | 388 |
| 2 | 4 | 518 | 699 | 283 | 332 |
| | 5-1 | 522 | 695 | 305 | 345 |
| | 5-2 | 530 | 698 | 319 | 364 |
| | 6 | 502 | 689 | 321 | 358 |
| | 7 | 512 | 691 | 315 | 348 |
| | 8 | 509 | 697 | 320 | 355 |
| | 9 | 460 | 710 | 310 | 360 |
| | 10 | 472 | 722 | 324 | 379 |
| 3 | 11 | 530 | 678 | 368 | 402 |
| | 12 | 524 | 656 | 359 | 399 |
| | 13 | 539 | 685 | 372 | 412 |
| | 14 | 533 | 679 | 369 | 401 |
| Zircaloy-4 | | 351 | 511 | 122 | 223 |

As shown in Table IV, zirconium alloys Nos. 1 to 14 of this invention displayed a higher mechanical strength than the former existing Zircaloy-4.

Effects of the Invention

From the above example, it was found that the zirconium alloys of this invention displayed superior corrosion resistance and high mechanical strength than the former existing Zircaloy-4. Therefore, the alloys of this invention can be utilized as fuel rod claddings, spacer grids and structural components, etc. in the reactor core of a nuclear power plants.

What is claimed is:

1. A zirconium alloy comprising an alloy composition as follows:

niobium (Nb), in a range of 0.15 to 0.25 wt. %;

tin (Sn), in a range of 1.10 to 1.40 wt. %;

iron (Fe), in a range of 0.35 to 0.45 wt. %;

chromium (Cr), in a range of 0.15 to 0.25 wt. %;

one element selected from the group consisting of copper (Cu) and manganese (Mn), in a range of 0.08 to 0.12 wt. %;

oxygen (O) in a range of 0.10 to 0.14 wt. %; and the balance being zirconium (Zr).

* * * * *